US008562205B2

(12) United States Patent
Journe

(10) Patent No.: US 8,562,205 B2
(45) Date of Patent: Oct. 22, 2013

(54) BI-AXIAL HIGH-PERFORMANCE ESCAPEMENT, OR BHPE (EBHP)

(75) Inventor: Francois-Paul Journe, Geneva (CH)

(73) Assignee: Montres Journe S.A., Geneva (CH)

( * ) Notice: Subject to any disclaimer, the term of this patent is extended or adjusted under 35 U.S.C. 154(b) by 77 days.

(21) Appl. No.: 13/370,510

(22) Filed: Feb. 10, 2012

(65) Prior Publication Data

US 2012/0207000 A1 Aug. 16, 2012

(30) Foreign Application Priority Data

Feb. 11, 2011 (EP) ..... 11405210

(51) Int. Cl.
*G04B 15/06* (2006.01)

(52) U.S. Cl.
CPC ..... *G04B 15/06* (2013.01)
USPC ..... 368/131

(58) Field of Classification Search
USPC ..... 368/127, 129–131
See application file for complete search history.

(56) References Cited

U.S. PATENT DOCUMENTS 2,354,020 A * 7/1944 Honger ..... 368/124
3,143,848 A * 8/1964 Biemiller et al. ..... 368/130
6,301,981 B1 * 10/2001 Oechslin ..... 74/1.5
6,708,576 B2 * 3/2004 Oechslin ..... 74/1.5
6,802,645 B2 * 10/2004 Ludwig ..... 368/127
2008/0259737 A1 * 10/2008 Cabezas Jurin et al. ..... 368/127
2008/0259739 A1 * 10/2008 Jurin et al. ..... 368/131

FOREIGN PATENT DOCUMENTS

| | | |
|---|---|---|
| CH | 27961 | 8/1963 |
| CH | 693516 | 9/2003 |
| EP | 0018796 | 11/1980 |
| EP | 1041459 | 10/2000 |
| EP | 1367462 | 12/2003 |
| EP | 1983389 | 10/2008 |
| WO | 9964936 | 12/1999 |

* cited by examiner

*Primary Examiner* — Vit W Miska
(74) *Attorney, Agent, or Firm* — Sturm & Fix LLP

(57) ABSTRACT

An escapement (1) comprising:
a roller (5),
a first mobile escapement part (2) comprising first escapement teeth (22) and a second mobile escapement part (3) comprising second escapement teeth (32),
a means (29, 39) for mechanically coupling the first mobile escapement part to the second mobile escapement part, and
an anchor (4) carrying a first and second pallet stone (42, 43),
the roller comprising a third impulse pallet stone (52) cooperating with the first escapement teeth and a fourth impulse pallet stone (53) cooperating with the second escapement teeth.

9 Claims, 2 Drawing Sheets

BI-AXIAL HIGH-PERFORMANCE ESCAPEMENT, OR BHPE (EBHP)

The invention relates to an escapement mechanism for a timepiece. The invention also relates to a timepiece comprising such an escapement mechanism.

In a timepiece, the escapement is used to maintain the oscillations of the regulating member and to count the oscillations of the regulating member. Thus, its operation is important in terms of the accuracy of the timepiece.

When it is desired to produce a wristwatch, in particular when it is desired to produce a chronometer wristwatch, it is essential to give particular attention and care to producing the escapement so that the escapement maintains the oscillations of the regulating member in a manner which is as regular as possible and so that it interferes as little as possible with the regulating member.

Moreover, it is also apparent that to achieve this object of accuracy and stability but also to achieve the object of reliability and efficiency, the structure of the escapement has to be as simple as possible.

EP 1 983 389 discloses an escapement mechanism comprising two escape wheels, two driving gear trains and two barrels, each escape wheel being driven by a driving gear train connected to a barrel. Such a system has a complex structure and is very difficult to regulate. It does not permit an escapement to be produced which is accurate and very efficient.

In addition, the object of the invention is to provide an escapement which remedies the cited drawbacks and improves the known escapements of the prior art. In particular, the invention proposes a simple and accurate escapement, i.e. which interferes as little as possible with the regulating member to which it is associated.

To this end, an escapement comprises:

a roller, a first mobile escapement part comprising first escapement teeth and a second mobile escapement part comprising second escapement teeth, a means for mechanically coupling the first mobile escapement part to the second mobile escapement part, and an anchor (or a lever) carrying pallet stones.

The roller may comprise a third pallet stone, in particular a third impulse pallet stone, cooperating with the first escapement teeth and a fourth pallet stone, in particular a fourth impulse pallet stone, cooperating with the second escapement teeth.

The first mobile escapement part may comprise a first escape wheel and a first coupling wheel and the second mobile escapement part may comprise a second escape wheel and a second coupling wheel.

The first coupling wheel may comprise third teeth and the second coupling wheel may comprise fourth teeth, the third teeth meshing with the fourth teeth.

The anchor may comprise a first pallet stone, in particular a first stop pallet stone, cooperating with the first escapement teeth and a second pallet stone, in particular a second stop pallet stone, cooperating with the second escapement teeth.

The second mobile escapement part may be designed to be coupled to an energy accumulator, such as a barrel including a mainspring, solely via the mechanical coupling means.

The anchor may comprise a fork cooperating with an impulse pin of the roller.

The roller may be of the double roller type and the anchor may comprise a guard pin cooperating with a small roller of the roller.

A timepiece, in particular a wristwatch, in particular a chronometer, comprises an escapement as defined above.

The timepiece may comprise an energy accumulator comprising a first barrel including a first mainspring and a second barrel including a second mainspring, the first and second barrels being mounted in parallel.

The accompanying drawings show by way of example an embodiment of an escapement according to the invention.

Figure 1:
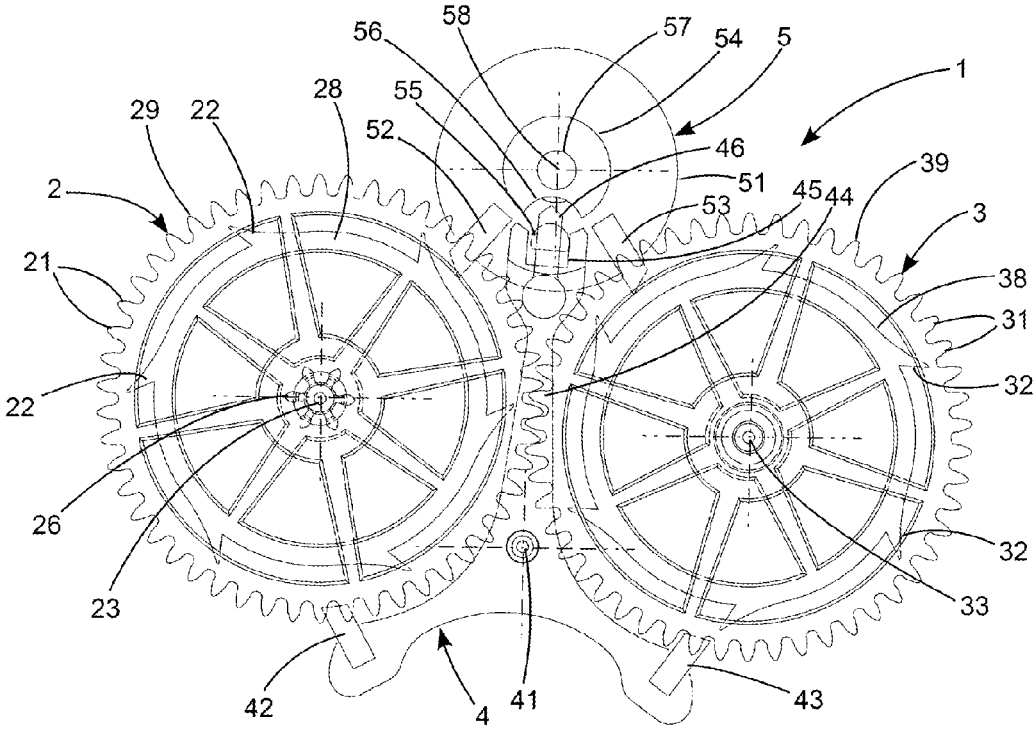
FIG. 1 is a front view of an embodiment of an escapement according to the invention.

An embodiment of an escapement mechanism 1 according to the invention is disclosed below with reference to FIGS. 1 to 6. Said escapement mechanism (known hereinafter as the escapement) is designed to be provided in a timepiece, in particular a wristwatch, and in particular a chronometer. For example, the escapement may be provided in a timepiece comprising an energy accumulator including a first barrel and a second barrel, the first and second barrels being mounted in parallel. The teeth of the two barrels are each able to mesh with the same center wheel of the driving gear train of the timepiece.

In principle, the escapement 1 comprises:

a roller 5, a first mobile escapement part 2 and a second mobile escapement part 3, a means 29, 39 for mechanically coupling the first mobile escapement part to the second mobile escapement part, and an anchor 4 (or a lever) carrying pallet stones 42, 43.

Advantageously, the first mobile escapement part comprises a first escape wheel 28 and a first coupling wheel 29. The first escape wheel comprises escapement teeth 22 designed to cooperate with the pallet stones. Preferably, the first escape wheel and the first coupling wheel are mounted coaxially on the same arbor 27. Depending on the axis of the arbor, the first escape wheel and the first coupling wheel may be easily mounted at a distance from one another, in particular so as to house the anchor 4 in an intermediate plane relative to said two wheels. More particularly, the arbor 27 has to have a specific length so that the guiding of the first mobile escapement part is sufficiently accurate. The first mobile escapement part also has a direct mechanical connection, designed to receive the energy transmitted by a driving gear train. Said direct mechanical connection comprises, for example, an escapement pinion 26 designed to mesh with a toothed wheel of a second mobile part. The first escape wheel, as in the case of the first coupling wheel, is fixedly mounted on the arbor. The first escape wheel, the first coupling wheel and the escapement pinion are in any case fixed in rotation. For example, the first escape wheel, the first coupling wheel and the escapement pinion may be mounted by means of grooves on the arbor. Moreover, the first escape wheel and the first coupling wheel are indexed in position relative to one another.

Advantageously, the second mobile escapement part comprises a second escape wheel 38 and a second coupling wheel 39. The second escape wheel comprises escapement teeth 32 designed to cooperate with pallet stones. Preferably, the second escape wheel and the second coupling wheel are mounted coaxially on the same arbor 37. Thus, the structure of the second mobile escapement part is identical to the structure of the first mobile escapement part with the difference that the second mobile escapement part does not have a direct mechanical connection to the driving gear train. For correct operation of the escapement, the first escape wheel and the second escape wheel are indexed in position relative to one another.

The first and second mobile escapement parts are movably mounted about separate axes, in particular movably mounted about axes which are parallel and separate.

The second mobile escapement part is designed to be coupled to an energy accumulator, such as a barrel, solely via the first mobile escapement part, and the mechanical coupling means 38, 39.

In this embodiment, the mechanical coupling means comprises the first coupling wheel of the first mobile part and the second coupling wheel of the second mobile part.

Advantageously, the first and second wheels comprise a limited number of teeth, for example 4 to 8 teeth, in particular 6 teeth each. Preferably, for correct operation of the escapement, the first escape wheel and the second escape wheel are indexed in position relative to one another, by being offset at an angle of n/n where n is equal to the number of teeth of each escape wheel.

Due to the mechanical coupling between the two mobile escapement parts, embodied by two toothed wheels meshing with one another, the two mobile escapement parts rotate in opposing directions. The rotational directions are represented by the arrows in FIGS. 2 to 4.

The anchor is mounted on an arbor 47. Said anchor is articulated about an axis 41. The anchor essentially carries at one end of a bar 44, on a first arm, a first stop pallet stone 42 cooperating with the teeth 22 of the first escape wheel and, on a second arm, a second stop pallet stone 43 cooperating with the teeth 32 of the second escape wheel. The anchor also comprises, at a different end of the bar, a fork 45 and a guard pin 46. The fork is designed to cooperate with an impulse pin 55 of the roller. The guard pin is designed to cooperate with a small roller 54 of the roller and a notch 56 formed in this small roller.

The roller is mounted on an arbor 57. Said roller is articulated about an axis 58. The roller 5 is of the double roller type. It thus comprises a large roller 51 and a small roller 54. The small roller is fixed in rotation to the large roller. An impulse pin 55 is positioned in the large roller and is designed to cooperate with the fork 45. Moreover, a third impulse pallet stone 52 cooperating with the teeth 22 of the first escape wheel is mounted, in particular attached, to the large roller. Similarly, a fourth impulse pallet stone 53 cooperating with the teeth 32 of the second escape wheel is mounted, in particular attached, to the large roller. As seen above, the small roller 54 and its notch 56 cooperate with the guard pin 46 of the anchor. The roller is designed to be mechanically coupled to the regulating member of the timepiece. For example, the roller is connected fixedly in terms of rotation to the regulating member, in particular fixedly connected in rotation to a balance wheel of a balance wheel-hairspring system.

Preferably, the axis 58 about which the roller is articulated and/or the axis 41 about which the anchor is articulated is contained in a plane which is central relative to the rotational axes 23, 33 of the first and second mobile escapement parts.

The operation of the escapement during one complete oscillation of the regulating member, such as a balance wheel-hairspring system, is described below with reference to FIGS. 2 to 4.

Figures 2, 3, 4:
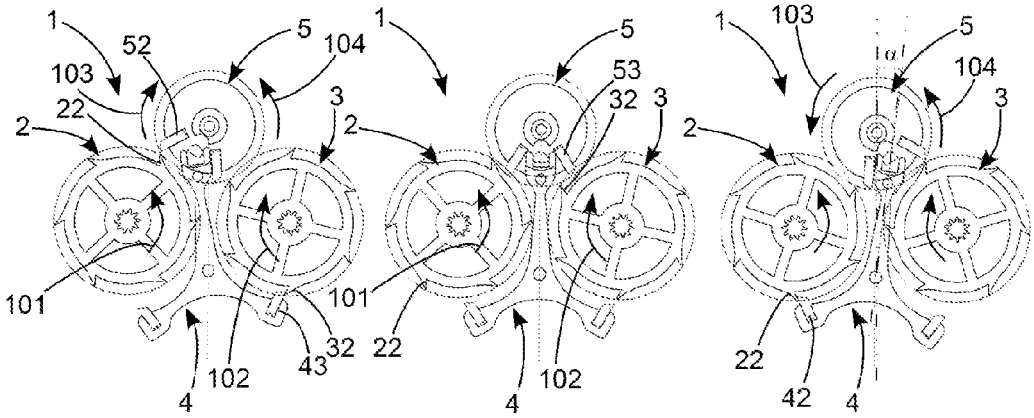
FIGS. 2 to 4 are front views of the embodiment of the escapement, the escapement being shown in different configurations in order to illustrate its operation.
Figure 5:
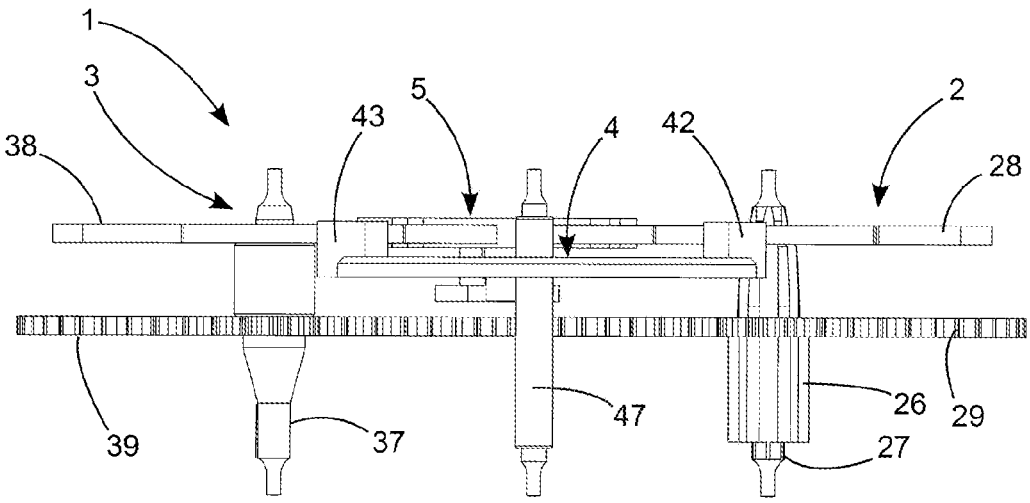
FIG. 5 is a side view of the embodiment of the escapement according to the invention.
Figure 6:
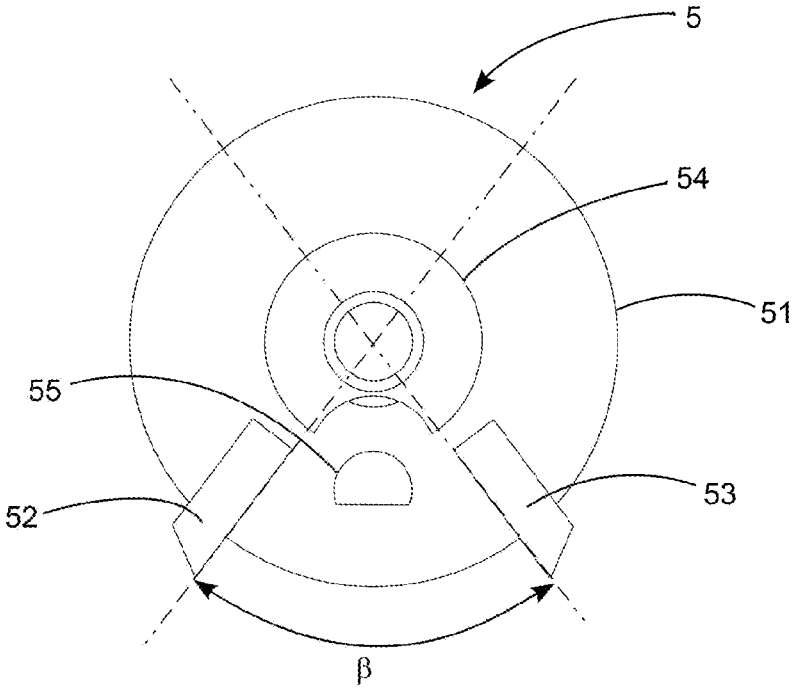
FIG. 6 is a front view of a detail of a double roller of the embodiment of the escapement according to the invention.

In the configuration of FIG. 2, it is assumed that the first mobile escapement part 2 has just provided the roller 5 with an impulse via the escapement tooth referenced 22 in FIG. 2 and the impulse pallet stone 52. The first mobile escapement part has thus just rotated in the direction indicated by the arrow 101 and the second mobile escapement part has thus just rotated in the direction indicated by the arrow 102. The anchor driven by the roller 5 via the impulse pin 55 has just pivoted in the counter-clockwise direction and has brought the stop pallet stone 43 into a position of interference with the escapement tooth of the second mobile escapement part referenced 32 of FIG. 2. The two mobile escapement parts are thus in a stop position: the second mobile escapement part being in a stop position as it is in contact with the stop pallet stone 43 and the first mobile escapement part being in a stop position as it is connected or coupled in rotation to the second mobile escapement part. In the configuration of FIG. 2, the roller has just received an impulse which it has transferred to the regulating member, in particular to the balance wheel of the regulating member. The roller fixed to the balance wheel thus continues its angular trajectory in the direction indicated by the arrow 103 to pass through an additional ascending arc, and then in the direction indicated by the arrow 104 to pass through an additional descending arc until returning to the configuration of FIG. 2.

In this configuration, the impulse pin returns to a position of cooperation with the fork of the anchor and drives said anchor in rotation in the clockwise direction until reaching the configuration of FIG. 3. In this configuration, an escapement tooth does not interfere with the stop pallet stone. The two mobile escapement parts thus rotate simultaneously in the directions shown by the arrows 101 and 102. This rotation of the mobile escapement parts continues until the tooth of the second mobile escapement part, referenced 32 in FIG. 3, comes to bear against the impulse pallet stone 53. From this contact, the second mobile escapement part 3 provides the roller 5 with an impulse via the escapement tooth referenced 32 and the impulse pallet stone 53. The second mobile escapement part thus continues to rotate in the direction indicated by the arrow 102 and the first mobile escapement part thus continues to rotate in the direction indicated by the arrow 101. The anchor driven by the roller 5 via the impulse pin 55 pivots in the clockwise direction and brings the stop pallet stone 42 into a position of interference with the tooth of the first mobile escapement part referenced 22 in FIGS. 3 and 4.

In the configuration shown in FIG. 4, the two mobile escapement parts are thus in a stop position: the first mobile escapement part being in a stop position as it is in contact with the stop pallet stone 42 and the second mobile escapement part being in a stop position as it is connected in terms of rotation to the first mobile escapement part. In the configuration of FIG. 4, the roller has just received an impulse which it has transferred to the regulating member, in particular to the balance wheel of the regulating member. The roller fixed to the balance wheel thus continues its angular path in the direction indicated by the arrow 104 to pass through an additional ascending arc, and then in the direction indicated by the arrow 103 to pass through an additional descending arc, until returning to the configuration of FIG. 4.

In this configuration, the impulse pin returns to a position of cooperation with the fork of the anchor and drives said anchor in rotation in the counter-clockwise direction until reaching a configuration similar to that of FIG. 3, this configuration differing solely from that of FIG. 3 by a rotation of the two mobile escapement parts of n/n radians where n is the number of escapement teeth of each mobile escapement part. In this configuration, an escapement tooth does not interfere with a stop pallet stone. The two mobile escapement parts thus rotate simultaneously in the directions shown by the arrows 101 and 102. This rotation of the mobile escapement parts continues until a tooth of the first mobile escapement part comes into contact with the impulse pallet stone 52. From this contact, the first mobile escapement part 3 provides the roller 5 with an impulse via the escapement tooth and the impulse pallet stone 52. The first mobile escapement part thus continues to rotate in the direction indicated by the arrow 101 and the second mobile escapement part thus continues to rotate in the direction indicated by the arrow 102. The anchor driven by the roller 5 via the impulse pin 55 pivots in the counter-clockwise direction and brings the stop pallet stone 43 into a position of interference with a tooth of the second mobile escapement part. Once again, the configuration of FIG. 2 is present.

As described above, the escapement is of the free type, i.e. the balance wheel is able to pass through an additional arc after the pin of the roller has left the fork of the anchor.

It is noteworthy that the structure of the escapement according to the invention is very simple. Similarly, each of the constituent parts, in particular the anchor, is very simple. It is also noteworthy that the escapement structure is symmetrical, the only elements of asymmetry being the presence of an escapement pinion on just one of the mobile escapement parts and an offset by an angle of n/n of the two escape wheels.

The simplicity mentioned above makes it possible to obtain a high degree of reliability and accuracy of operation.

This simplicity also contributes to the efficiency of the escapement. More specifically, in the escapement disclosed above, the energy from the energy accumulator is transmitted to the regulating member directly from the escape wheels to the roller, in contrast to a conventional Swiss anchor escapement where the energy passes through via the anchor. Thus, the escapement is of the detent escapement type. Such a particularity makes it possible to improve the efficiency. In the escapement described above, the function of the impulse pin and the fork is limited to the position of the anchor.

Moreover, it is noteworthy that each of the escape wheels transmits a single impulse to the regulating member during one oscillation. The first escape wheel transmits an impulse to the regulating member during the first alternation of the oscillation and the second escape wheel transmits an impulse to the regulating member during the second alternation of the oscillation. This direct transmission of energy from an escape wheel to the roller with each alternation makes it possible to improve the accuracy. The regulating member receives impulses when it is located in symmetrical positions.

It is also noteworthy that the escapement permits an automatic initiation of the movement when the mainspring is wound. More specifically, it is seen in the configuration of FIG. 3, which corresponds to the resting position of the regulating member, that none of the stop pallet stones is in a configuration where it is in interference with a tooth of the escape wheels. As a result, when the mainspring is wound, the mobile escapement parts naturally rotate and transmit a first impulse to the regulating member permitting the movement to be initiated.

In the escapement described above, as shown in FIG. 6, the angle β formed between the planes of the impulse pallet stones 52 and 53 may, for example, range between 55° and 66°. The return of the escape wheel when the stop pallet stone leaves an interference position may be 0.5°. The pivoting amplitude of the anchor (2xα) may be 14°.

Advantageously, the escape wheels, or even further elements of the mobile escapement parts, may be produced from a material of high volumetric mass, for example from gold.

An escapement according to the invention does not require lubrication.

The invention claimed is:

1. An escapement comprising:

a roller, a first mobile escapement part comprising first escapement teeth and a second mobile escapement part comprising second escapement teeth, a means for mechanically coupling the first mobile escapement part to the second mobile escapement part, and an anchor carrying a first and second pallet stone, the roller comprising a third impulse pallet stone cooperating with the first escapement teeth and a fourth impulse pallet stone cooperating with the second escapement teeth.

2. The escapement as claimed in claim 1, wherein the first mobile escapement part comprises a first escape wheel and a first coupling wheel and in that the second mobile escapement part comprises a second escape wheel and a second coupling wheel.

3. The escapement as claimed in claim 2, wherein the first coupling wheel comprises third teeth and the second coupling wheel comprises fourth teeth, the third teeth meshing with the fourth teeth.

4. The escapement as claimed in claim 1, wherein the anchor comprises the first pallet stone , in particular a first stop pallet stone cooperating with the first escapement teeth and the second pallet stone, in particular a second stop pallet stone cooperating with the second escapement teeth.

5. The escapement as claimed in claim 1, wherein the second mobile escapement part is designed to be coupled to an energy accumulator, such as a barrel, solely via the mechanical coupling means.

6. The escapement as claimed in claim 1, wherein the anchor comprises a fork cooperating with an impulse pin of the roller.

7. The escapement as claimed in claim 1, wherein the roller is of the double roller type and in that the anchor comprises a guard pin cooperating with a small roller of the roller.

8. A timepiece, in particular a wristwatch, in particular a chronometer, comprising an escapement as claimed in claim 1.

9. The timepiece as claimed in claim 8, wherein it comprises an energy accumulator comprising a first barrel and a second barrel, the first and second barrels being mounted in parallel.

* * * * *